US012391503B2

(12) United States Patent
Rauscher et al.

(10) Patent No.: US 12,391,503 B2
(45) Date of Patent: Aug. 19, 2025

(54) METHOD FOR WINDING A MATERIAL SHEET AND WINDING DEVICE

(71) Applicant: SML MASCHINENGESELLSCHAFT M.B.H., Redlham (AT)

(72) Inventors: Thomas Rauscher, Berg im Attergau (AT); Christoph Iglseder, Attnang-Puchheim (AT)

(73) Assignee: SML MASCHINENGESELLSCHAFT M.B.H., Redlham (AT)

( * ) Notice: Subject to any disclaimer, the term of this patent is extended or adjusted under 35 U.S.C. 154(b) by 202 days.

(21) Appl. No.: 18/219,994

(22) Filed: Jul. 10, 2023

(65) Prior Publication Data

US 2024/0116730 A1 Apr. 11, 2024

(30) Foreign Application Priority Data

Jul. 13, 2022 (EP) ..... 22184594

(51) Int. Cl.
*B65H 23/18* (2006.01)

(52) U.S. Cl.
CPC . *B65H 23/1806* (2013.01); *B65H 2301/5151* (2013.01); *B65H 2404/16* (2013.01); *B65H 2513/11* (2013.01); *B65H 2701/1752* (2013.01)

(58) Field of Classification Search
CPC B65H 23/18; B65H 23/1806; B65H 23/1888; B65H 23/192
See application file for complete search history.

(56) References Cited

U.S. PATENT DOCUMENTS

| | | | | |
|---|---|---|---|---|
| 2,975,991 | A * | 3/1961 | Michel | B65H 23/1806 242/422.3 |
| 5,474,248 | A * | 12/1995 | Bradshaw | B65H 23/1806 242/530.4 |
| 5,967,437 | A | 10/1999 | Martin-Cocher | |
| 8,100,356 | B2 | 1/2012 | Pirtle | |
| 10,167,158 | B2 * | 1/2019 | Nishimura | B65H 18/103 |
| 10,494,215 | B2 | 12/2019 | Galea | |
| 2003/0189118 | A1 * | 10/2003 | Smith | B65H 18/28 242/530.4 |
| 2014/0020890 | A1 | 1/2014 | Corre | |
| 2019/0389121 | A1 | 12/2019 | Kataoka | |
| 2022/0009739 | A1 * | 1/2022 | Sforzi | B65H 23/1806 |

FOREIGN PATENT DOCUMENTS

| | | | |
|---|---|---|---|
| EP | 0176230 | A1 | 4/1986 |
| EP | 1138620 | A2 | 10/2001 |
| JP | H02225243 | A | 9/1990 |

* cited by examiner

*Primary Examiner* — Sang K Kim
(74) *Attorney, Agent, or Firm* — LUCAS & MERCANTI, LLP; Klaus P. Stoffel

(57) ABSTRACT

A method for winding a material sheet, in particular a plastic film, by a winding device, wherein the material sheet is guided from at least one first roller to at least one second roller in a conveying direction. At least one cutting device is arranged between the first roller and the second roller to cut the material sheet into at least two partial sheets. The partial sheets are each wound up into a bobbin in the conveying direction behind the second roller. The at least one first roller and the at least one second roller are each driven by a drive so that the tensile stress in the material sheet or in the partial sheets changes periodically over time in the conveying direction of the material sheet.

16 Claims, 4 Drawing Sheets

METHOD FOR WINDING A MATERIAL SHEET AND WINDING DEVICE

CROSS-REFERENCE TO RELATED APPLICATIONS

The present application claims priority of EP 22 184 594.4, filed Jul. 13, 2022, the priority of this application is hereby claimed, and this application is incorporated herein by reference.

BACKGROUND OF THE INVENTION

The invention relates to a method for winding a material sheet, in particular a plastic film, by means of a winding device, wherein the material sheet is guided from at least one first roller to at least one second roller in a conveying direction, wherein at least one cutting device is arranged between the first roller and the second roller, which cutting device cuts the material sheet into at least two partial sheets, wherein the partial sheets are each wound up into a bobbin in the conveying direction behind the second roller. Furthermore, the invention relates to a winding device.

When winding partial sheets that have been cut out of a material sheet (film web), changes in the material and therefore damage to the cut edge typically occur when cutting the material sheet, especially the film, in the conveying direction (production direction), in particular due to the recipe used, the conveying speed of the material sheet, the tension in the film and the blades (knives) used. If the cut edge is always wound at the same point during winding, problems arise so that the finished roll may become unusable, i.e. in particular it can no longer be unwound without damage.

To avoid this problem, it is known from US 2014/0208905 A1 and U.S. Pat. No. 10,494,215 B2 that a relative oscillating movement is provided between the cutting blade and the film to be cut, according to which the film is cut by blades that oscillate transversely to the direction in which the film is conveyed. U.S. Pat. No. 5,967,437 provides for the wound roll itself to oscillate relative to the knife transversely to the direction of conveyance. A solution similar to this is provided by U.S. Pat. No. 8,100,356 B2, in which a roller is oscillated before winding. Further solutions to the generic technology disclose EP 0 176 230 A1, EP 1 138 620 A2, JP H02 225 243 A and US 2019/389121 A1.

All of the above solutions require special connecting elements, drives, eccentrics, cylinders, etc. This means that the technical equipment required is correspondingly large and the systems used are relatively expensive.

SUMMARY OF THE INVENTION

The invention is therefore based on the object of providing a method and a device of the type mentioned above, with which it is possible to ensure in a simple manner and without high device-related expenditure that favourably wound rolls can be produced in which the above-mentioned problems do not occur.

The solution to this object by the invention is characterised by the fact that the at least one first roller and the at least one second roller are each driven by a drive in such a way that the tensile stress in the material sheet or in the partial sheets changes periodically over time in the conveying direction of the material sheet.

It is particularly preferred that the at least one first roller and the at least one second roller are each driven by their drive in such a way that the tensile stress in the material sheet or in the partial sheets changes essentially sinusoidally around an average value. The time-variable tensile stress can be achieved by controlling or regulating the rotational speed of at least one of the drives of the rollers in a time-variable manner (and in particular on the basis of a superimposed sinus function).

In this respect, it has proven useful if it is provided that the maximum tensile stress applied to the material sheet or to the partial sheets varies such that the maximum value of the tensile stress is higher than the minimum value of the tensile stress by at least 0.1%, preferably by at least 1.5% and particularly preferably by at least 5.0%.

According to a preferred embodiment, the at least one first roller cooperates with another roller in order to be able to build up tensile stress in the material sheet or in the partial sheets. Correspondingly, it can also be provided that the at least one second roller cooperates with another roller in order to be able to build up tensile stress in the material sheet or in the partial sheets.

Preferably, the at least one first roller is driven with a constant rotational speed and the at least one second roller is driven with a rotational speed that changes over time. With regard to the time-varying rotational speed, it is preferred that this change takes place in such a way that the maximum value of the rotational speed is higher than the minimum value of the rotational speed by at least 0.1%, preferably by at least 1.5% and particularly preferably by at least 5.0%. For the change of the rotational speed, a periodically changing course and in particular a course similar to a sinusoid is preferably specified.

Preferably, the change of the tensile stress in the material sheet or in the partial sheets takes place in such a way that the width of the material sheet or the partial sheets changes by a value of +/−0.1 mm to +/−5 mm around the average value of the width. The average value is to be understood as the arithmetic mean value of the corresponding sheet, which changes here according to periodically by the dimensions mentioned.

The proposed winding device for winding a material sheet, in particular a plastic film, has at least one first roller and at least one second roller with which the material sheet can be guided in a conveying direction, wherein the first roller and the second roller each being connected to a drive, with which the rollers can be rotated, furthermore at least one cutting device which is arranged between the first roller and the second roller in order to be able to cut the material web into at least two partial webs, and at least one winder for winding up the partial webs, the winder being arranged downstream of the second roller in the conveying direction. According to the invention, it is provided that the drives of the first roller and of the second roller are connected to a control device, wherein the control device is designed to drive one of the rollers at a periodically variable rotational speed.

Preferably, the control device is designed to drive one of the rollers in such a way that the rotational speed of the roller varies substantially sinusoidally around an average value.

In order to create sufficient adhesion between the film and the roller, it can be provided that the at least one first roller cooperates with another roller and/or that the at least one second roller cooperates with another roller.

Preferably, at least one of the rollers is provided with a profiling on the roller surface.

In the method proposed according to the invention, the material sheet, in particular the plastic film, is thus selectively stretched or relaxed by changing the tensile stress in the material between two rollers and in particular by the selective acceleration or deceleration of rollers, so that the material sheet changes in width due to a different degree of necking.

After the tensile stress in the material has been reduced, the cut edge of the partial sheet is no longer straight but wavy and, in particular, "sinusoidal".

The proposed method is used in particular after trimming the film.

Changing the width of the material web or the partial webs, preferably in a range between +/−0.1 mm to +/−5 mm, means that the cut edge is not always wound at the same point during the subsequent winding of the partial webs.

This makes it possible to wind the partial sheets of the film without defects, i.e. in particular without edge welds, defects and unwindable areas.

Thus, the proposed method ensures that the cut edge of the film is not always in the same place for the individual partial sheets during winding, which can prevent the winding problems mentioned above.

Advantageously, this is made possible according to the present invention in a very cost-effective manner, since no additional device parts (for carrying out oscillating movements transverse to the conveying direction of the material web) have to be provided.

Furthermore, the proposed approach can be activated and deactivated in the process so that there is no interference with production. In the previously discussed solutions with the oscillation of the knives, a change in the production conditions requires a stop of the system, which creates waste.

Furthermore, the proposed method can advantageously be used independently of the width of the bobbins. The width of the partition can be adjusted as desired, and in particular the number of partitions or bobbins can also be flexibly selected.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
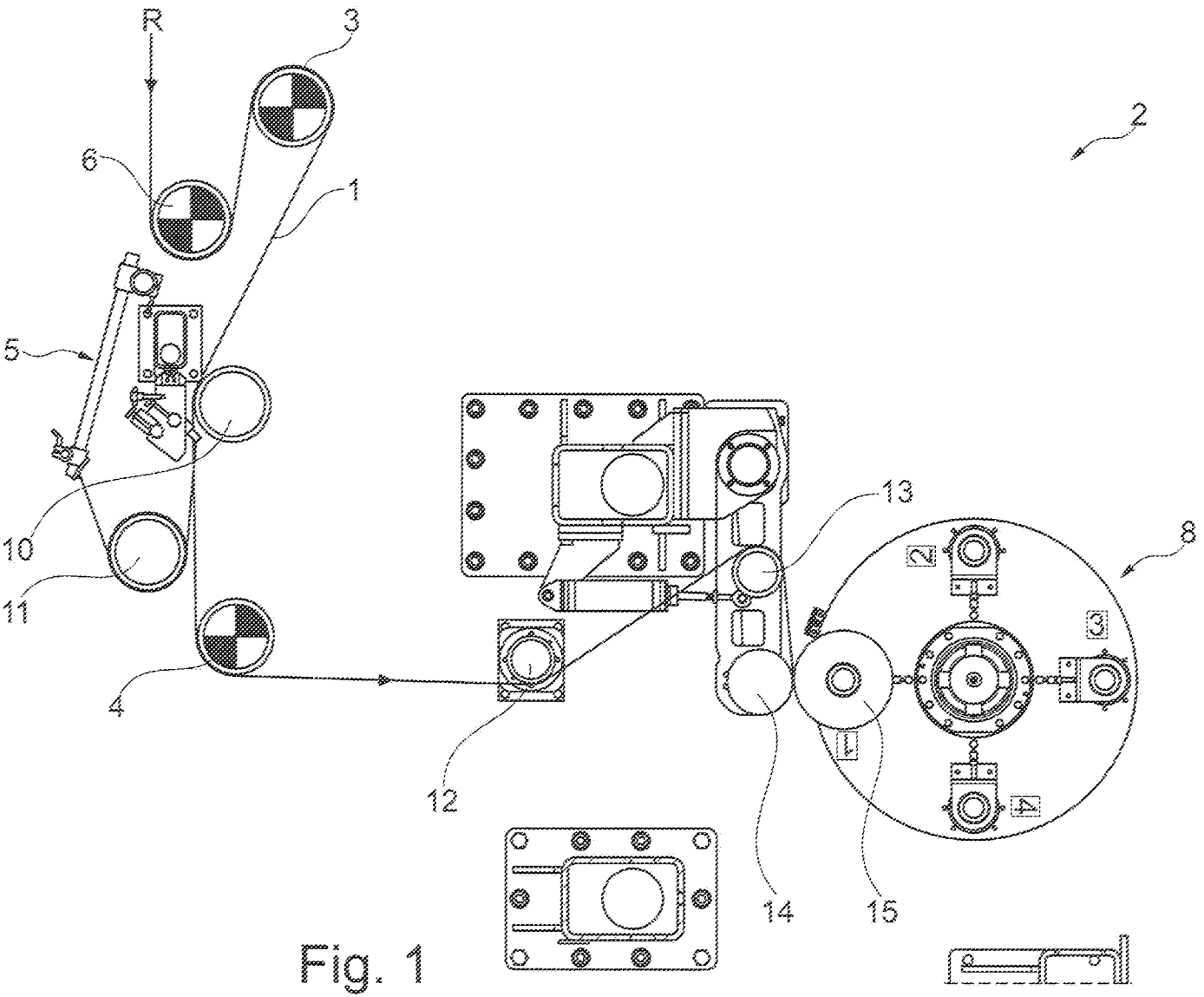
FIG. 1 shows a schematic side view of a winding device for winding a film sheet cut into partial sheets according to a first embodiment of the invention.
Figure 2:
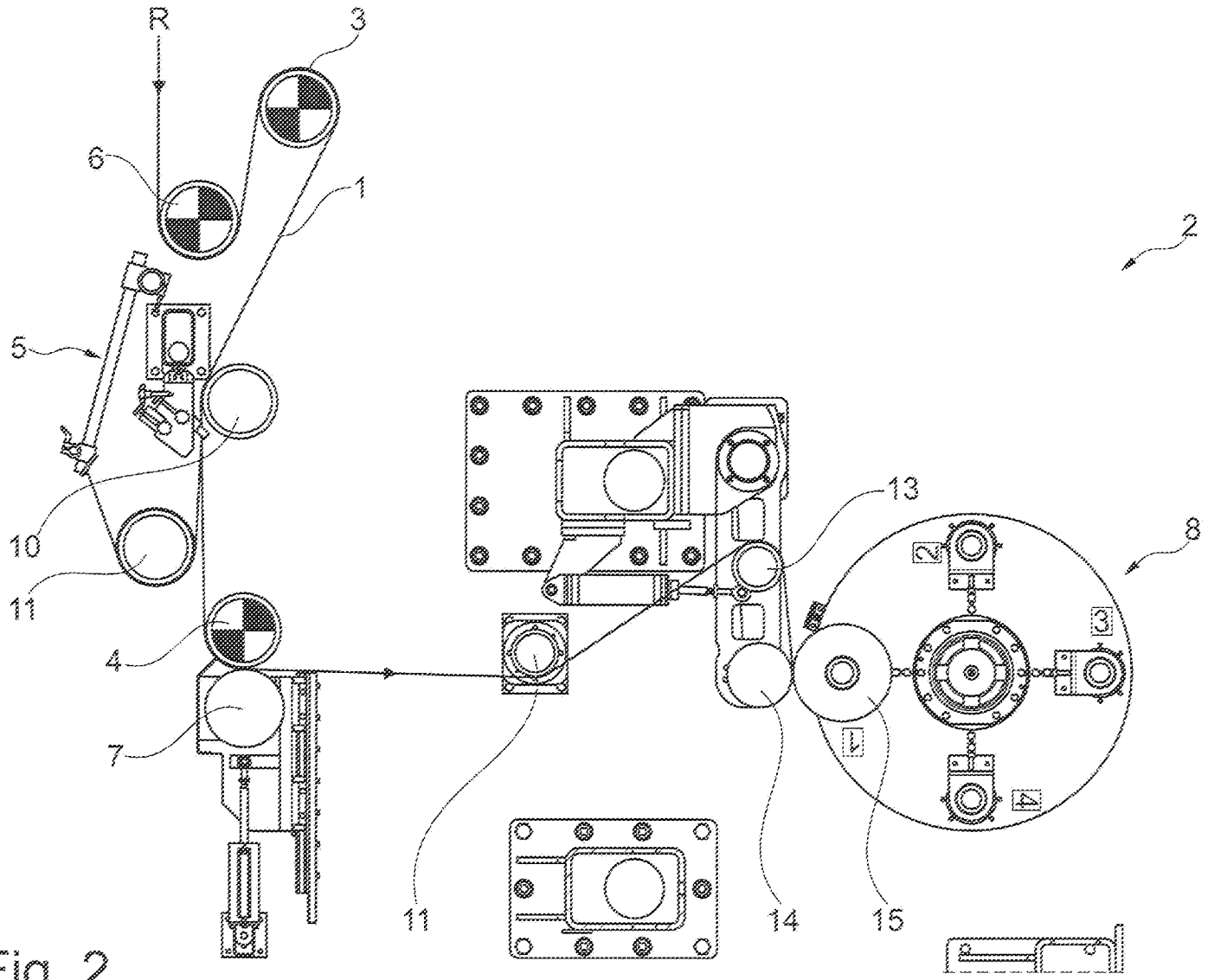
FIG. 2 shows an alternative design of the winding device to FIG. 1, FIG. 3 schematically shows three partial sheets cut out of the film sheet, illustrating the change in width due to the application of different tensile stresses.

FIGS. 1 and 2 show two very similar embodiments of a winding device 2, with which a sheet of material 1 in the form of a plastic film is cut into partial sheets 1*a*, 1*b*, 1*c* and the latter are then wound up into finished wound film bobbins 15.

Essential elements of the winding device 2 are a first roller 3, which is preferably designed as a driven fixed-point roller, and a second roller 4, which is preferably designed as a lower cutting roller. In the conveying direction R of the material sheet 1 between the two rollers 3 and 4 there is a cutting device 5 with which the material sheet 1 is cut into the partial sheets 1*a*, 1*b*, 1*c*.

Not shown are drives with which on the one hand the first roller 3 and on the other hand the second roller 4 are driven in rotation. Likewise not shown is a control device with which the drives of the rollers are controlled.

The central aspect of the proposed concept is that the tensile stress in the material sheet 1 or in the partial sheets 1*a*, 1*b*, 1*c* (after the cut) is variable over time. Although the first roller 3 is driven with a constant rotational speed determined for the production process, the second roller 4 is driven with a non-constant rotational speed. Preferably, a sinusoidal curve is superimposed on a basic rotational speed of the second roller 4, so that the rotational speed of the second roller 4 changes accordingly.

Figure 3:
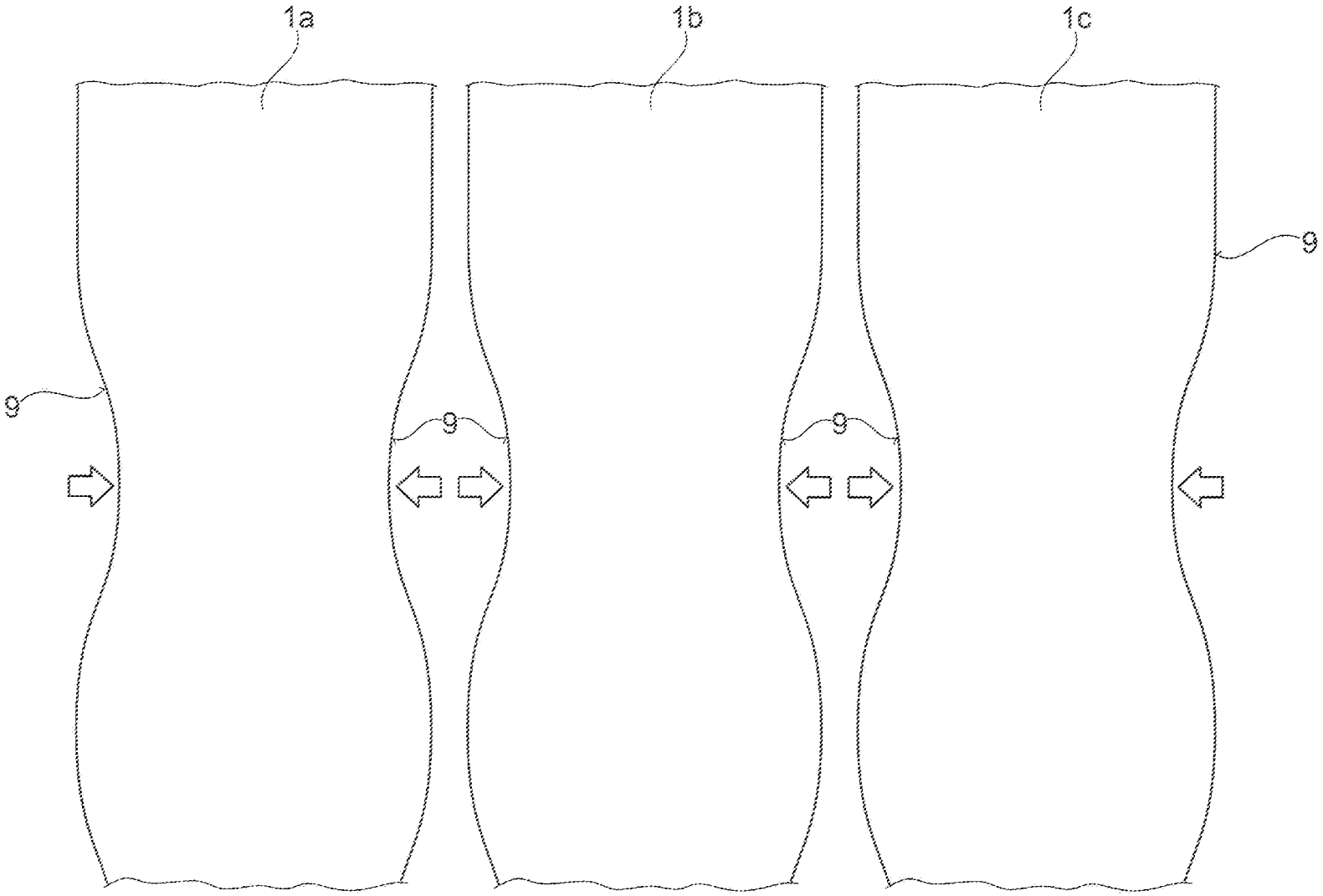

As a result, the material sheet 1 or the partial sheets 1*a*, 1*b*, 1*c* between the two rollers 3 and 4 are subjected to a variable tensile stress, which is illustrated in FIG. 3. At the points marked with arrows in FIG. 3, those sections are marked where the material web was subjected to increased tensile stress. Accordingly, the material sheet 1 or the partial sheets 1*a*, 1*b*, 1*c* cut out from it have constricted as shown in FIG. 3.

Figure 4:
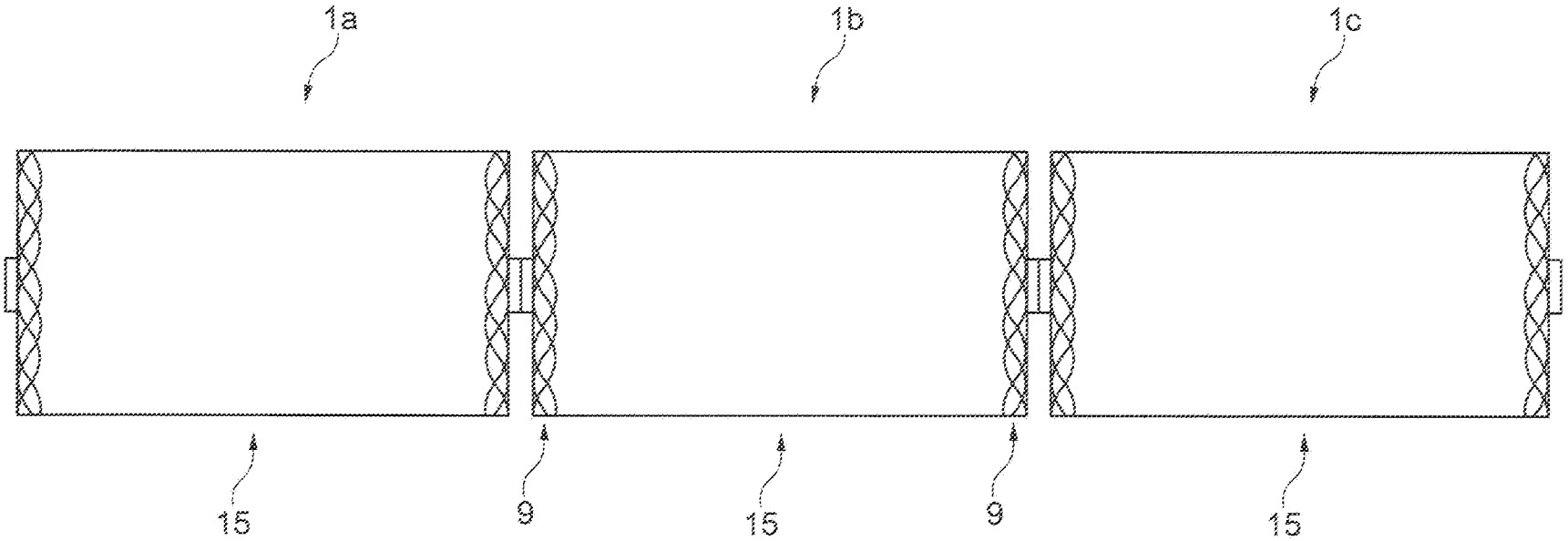
FIG. 4 shows the partial sheets wound up into a bobbin after the winding process has been completed.

If the partial sheets cut in this way are wound, the result is film bobbins 15 as depicted in FIG. 4. The cutting edges 9 do not all lie on top of each other, but run variably, which facilitates the unwinding of the film from the film bobbin 15.

FIGS. 1 and 2 also show a number of elements, some of which are advantageous for the present invention, but some of which are also sufficiently known in the prior art.

Mention should be made of the further roller 6, which interacts with the first roller 3 and which is designed as a driven fixed-point roller.

FIG. 1 does not show that the second roller 4 interacts with another roller. However, this is illustrated in FIG. 2, where reference is made to the other roller 7, which acts as a pressure roller.

Downstream of the second roller 4 in conveying direction R is a winder 8 with several winding stations on which the finished film bobbins 15 are wound.

FIGS. 1 and 2 also show an upper cutting roller 10, a strip discharge roller (conveying roller for strip) 11, a roller for tension measurement 12, a satellite roller 13 and a contact roller 14, which are useful for the proper production process.

The tension in the material sheet 1 or the partial sheets 1*a*, 1*b*, 1*c* can be measured in the longitudinal direction via the roller for tension measurement 12. This makes it possible, for example, to specify a sinusoidal course for the tension in the material and to regulate it accordingly.

The material sheet, i.e. the film, is thus stretched in the conveying direction (longitudinal direction) by the proposed change in tensile stress in the material, which changes the width of the film (see FIG. 3).

This means that the cutting edge does not always meet at the same point when the partial sheet is wound up, as shown in FIG. 4.

The first and second rollers 3 and 4 and, if applicable, the further rollers 6 and 7 cooperating with these rollers can have a profiled, in particular spiralised and/or roughened surface so that the corresponding tension can be reliably built up in the material web between the rollers.

Generally, the rollers between which the tensile stress is built up (as a result of targeted acceleration or braking of the rollers) are one or more rollers before the cut and one or more rollers after the cut, wherein the first roller 3 and the second roller 4 can be: the upper cutting roller and the lower cutting roller; the fixed-point roller and the roller for tension measurement or the satellite roller; the fixed-point roller and the contact roller.

If the adhesion on the surface of the roller is not sufficient to build up the required tension in the material web between the first and the second roller 3, 4, a pressure roller (as shown in FIG. 2) can be provided, which in this embodiment is placed at the lower cutting roller and interacts with it.

Preferably, the roller or rollers before the cut (in the embodiment the first roller 3 together with the further roller 6) is used as a "fixed point", i.e. these rollers move with a constant rotational speed. The roller or rollers after the cut (in the embodiment the second roller 4 together with the further roller 7) are driven with a non-uniform rotational speed, so that the material web between the first and second roller is periodically accelerated or decelerated by changing the rotational speed of these rollers.

As shown in FIG. 3, this changes the width of the film; the cut edges 9 are not wound in the same place during winding.

According to a preferred embodiment of the invention, the rotational speed of one roller (e.g. roller 4) is periodically changed in such a way that, starting from a nominal value of 100%, the roller is accelerated for a period of e.g. 1 s, whereby an increased value of the rotational speed of 101.5% is achieved by the acceleration. The roller is then braked for approximately the same period of time (e.g. 1.1 s) until the nominal value of the rotational speed of 100% is reached again. This process is repeated periodically to achieve the described effect of changing the width of the web.

While specific embodiments of the invention have been shown and described in detail to illustrate the inventive principles, it will be understood that the invention may be embodied otherwise without departing from such principles.

We claim:

1. A method for winding a material sheet with a winding device, wherein the material sheet is guided from at least one first roller to at least one second roller in a conveying direction, wherein at least one cutting device is arranged between the first roller and the second roller, wherein the cutting device cuts the material sheet into at least two partial sheets, wherein the partial sheets are each wound up into a bobbin in the conveying direction behind the second roller, wherein the at least one first roller and the at least one second roller are each driven by a drive in such a way that the tensile stress in the material sheet or in the partial sheets changes periodically over time in the conveying direction of the material sheet so that cutting edges of the partial sheets when wound up into the bobbin do not all lie on top of each other, but run variably.

2. The method according to claim 1, wherein the at least one first roller and the at least one second roller are each driven by their drive in such a way that the tensile stress in the material sheet or in the partial sheets changes essentially sinusoidally around an average value.

3. The method according to claim 1, wherein the maximum tensile stress applied to the material sheet or to the partial sheets varies such that the maximum value of the tensile stress is higher than the minimum value of the tensile stress by at least 0.1%.

4. The method according to claim 3, wherein the maximum tensile stress applied to the material sheet or to the partial sheets varies such that the maximum value of the tensile stress is higher than the minimum value of the tensile stress by at least 1.5%.

5. The method according to claim 4, wherein the maximum tensile stress applied to the material sheet or to the partial sheets varies such that the maximum value of the tensile stress is higher than the minimum value of the tensile stress by at least 5.0%.

6. The method according to claim 5, wherein the time-varying rotational speed is changed in such a way that the maximum value of the rotational speed is higher than the minimum value of the rotational speed by at least 5.0%.

7. The method according to claim 1, wherein the at least one first roller cooperates with a further roller in order to be able to build up a tensile stress in the material sheet or in the partial sheets.

8. The method according to claim 1, wherein the at least one second roller cooperates with a further roller in order to be able to build up a tensile stress in the material sheet or in the partial sheets.

9. The method according to claim 1, wherein the at least one first roller is driven at a constant rotational speed and the at least one second roller is driven at a time-varying rotational speed.

10. The method according to claim 9, wherein the time-varying rotational speed is changed in such a way that the maximum value of the rotational speed is higher than the minimum value of the rotational speed by at least 0.1%.

11. The method according to claim 10, wherein the time-varying rotational speed is changed in such a way that the maximum value of the rotational speed is higher than the minimum value of the rotational speed by at least 1.5%.

12. The method according to claim 1, wherein the change in the tensile stress in the material sheet or in the part sheets is effected in such a way that the width of the material sheet or of the part sheets changes by a value of +/−0.1 mm to +/−5 mm about the average value of the width.

13. A winding device for winding a material sheet, which comprises:

at least one first roller and at least one second roller with which the material sheet can be guided in a conveying direction, wherein the first roller and the second roller are each connected to a drive with which the rollers can be rotated, at least one cutting device arranged between the first roller and the second roller in order to be able to cut the material sheet into at least two partial sheets, at least one winder for winding up the partial sheets, wherein the winder is arranged downstream of the second roller in the conveying direction, wherein the drives of the first roller and the second roller are connected to a control device, wherein the control device is configured to drive one of the rollers at a periodically variable rotational speed so that cutting edges of the partial sheets when wound up into the bobbin do not all lie on top of each other, but run variably.

14. The winding device according to claim 13, wherein the control device is configured to drive one of the rollers in such a way that the rotational speed of the roller varies substantially sinusoidally around an average value.

15. The winding device according to claim 13, wherein the at least one first roller cooperates with the further roller and/or that the at least one second roller cooperates with a further roller.

16. The winding device according to claim 15, wherein at least one of the rollers has a profiling on the roller surface.

* * * * *